US007656264B2

(12) United States Patent
Hsu et al.

(10) Patent No.: US 7,656,264 B2
(45) Date of Patent: Feb. 2, 2010

(54) HIGH COUPLING FACTOR TRANSFORMER AND MANUFACTURING METHOD THEREOF

(75) Inventors: Tsun-Lai Hsu, Hsinchu Hsien (TW); Tsuoe-Hsiang Liao, Hsinchu (TW); Jun-Hong Ou, Taipei (TW)

(73) Assignee: United Microelectronics Corp., Hsinchu (TW)

( * ) Notice: Subject to any disclaimer, the term of this patent is extended or adjusted under 35 U.S.C. 154(b) by 495 days.

(21) Appl. No.: 11/550,808

(22) Filed: Oct. 19, 2006

(65) Prior Publication Data

US 2008/0094166 A1 Apr. 24, 2008

(51) Int. Cl.
*H01F 27/28* (2006.01)

(52) U.S. Cl. ..... 336/223; 336/200

(58) Field of Classification Search ..... 336/223
See application file for complete search history.

(56) References Cited

U.S. PATENT DOCUMENTS

| | | | |
|---|---|---|---|
| 4,816,784 | A | 3/1989 | Rabjohn |
| 6,577,219 | B2 | 6/2003 | Visser |
| 6,608,364 | B2 | 8/2003 | Carpentier |
| 6,927,664 | B2 | 8/2005 | Nakatani et al. |

OTHER PUBLICATIONS

Heng-Ming-Hsu. "Implementation of High-Coupling and Broadband Transformer in RFCMOS Technology" published in Journal of Solid-State Circuit, vol. 52, No. 7, p. 1410-1414, Jul. 2005.

Alireza Zolfaghari et al. "Stacked Inductors and Transformers in CMOS Technology" published in Journal of Solid-State Circuit, vol. 36, No. 4, p. 620-628, Apr. 2001.

Kachun Kwok et al. "Ultra-Low-Voltage High-Performance CMOS VCOs Using Transformers Feedback" published in Journal of Solid-State Circuit, vol. 40, No. 3, p. 652-660, Mar. 2005.

Nam-Jin Oh et al. "11-GHz CMOS Differential VCO With Back-Gate Transformer Feedback" published in Microwave and Wireless Components Letters, vol. 15, No. 11, p. 733-735, Nov. 2005.

David J. Cassan et al. "A 1-V Transformer-Feedback Low-Noise Amplifier for 5-GHz Wireless LAN in 0.18-μm CMOS" published in Journal of Solid-State Circuit, vol. 38, No. 3, p. 427-435, Mar. 2003, of the Institute of Electrical and Electronic Engineers (IEEE).

Jian-Jun Zhou et al. Paper No. FA8.6, entitled "A Fully Integrated CMOS 900MHz LNA utilizing Monolithic Transformers," of the International Solid-State Circuits Conference (ISSCC98).

*Primary Examiner*—Elvin G Enad
*Assistant Examiner*—Joselito Baisa
(74) *Attorney, Agent, or Firm*—Jianq Chyun IP Office

(57) ABSTRACT

A high coupling factor transformer and a manufacturing method thereof are provided. The transformer includes a primary winding and a secondary winding. The secondary winding is adjacent to the primary winding. The secondary winding and the primary winding induct with each other. The primary winding includes a plurality of first protruding portions, and the secondary winding includes a plurality of second protruding portions. The first protruding portions stretch to the secondary winding without electro-contact, and the second protruding portions stretch to the primary winding without electro-contact.

39 Claims, 16 Drawing Sheets

HIGH COUPLING FACTOR TRANSFORMER AND MANUFACTURING METHOD THEREOF

BACKGROUND OF THE INVENTION

1. Field of the Invention

The present invention relates to a transformer and a manufacturing method thereof. More particularly, the present invention relates to a high coupling factor transformer and a manufacturing method thereof.

2. Description of Related Art

Some application circuits, such as radio frequency circuits, voltage controlled oscillator circuits, and mixer circuits, generally have one or more transformers. With the present trend developing lighter, thinner, shorter and smaller electronic products, transformers in an electronic circuit are usually implemented in an integrated circuit. In the application of a transformer, the coupling factor k is quite an important parameter in circuit design. A high k value means a high energy (or signal) conversion rate, which also means that the energy (or signal) loss can be reduced.

FIG. 7 illustrates the layout of a general transformer. Referring to FIG. 7, the conventional transformer 700 is a planar transformer. Generally speaking, in order to avoid the coupling effect between the transformer and the devices of the IC, the transformer is usually disposed far from the substrate. For example, if eight metal layers are composed in the manufacturing of the transformer 700, a primary winding 710 and a secondary winding 720 are normally disposed at the eighth metal layer M8. FIG. 8A illustrates the characteristic of the coupling factor k of the transformer in FIG. 7. FIG. 8A is a measurement result of the frequency ranged at 0~20 GHz obtained from the primary winding 710 and the secondary winding 720 of the transformer. The outer diameter of the transformer 700 is 250 um, and the width of the windings and the distance between the windings are respectively 9 um and 1.6 um. FIG. 8B illustrates the characteristic of the coupling factor k of the transformer in FIG. 8A when the frequency is ranged between 0~3.5 GHz. It is clear from FIG. 8B that the coupling factor k is about 0.745 when the working frequency of the transformer 700 is 1 GHz.

Furthermore, other various types of transformers have been disclosed in different documents for improving the coupling factor k value. For example, the implementations of various transformers are disclosed in *Implementation of High-Coupling and Broadband Transformer in RFCMOS Technology* published in *Journal of Solid-State Circuit*, Vol. 52, No. 7, page 1410-1414, July 2005, *Stacked Inductors and Transformers in CMOS Technology* published in *Journal of Solid-State Circuit*, Vol. 36, No. 4, page 620-628, Apr. 2001, *Ultra-Low-Voltage High-Performance CMOS VCOs Using Transformers Feedback* published in *Journal of Solid-State Circuit*, Vol. 40, No. 3, page 652-660, Mar. 2005, 11-GHz *CMOS Differential VCO With Back-Gate Transformer Feedback* published in *Microwave and Wireless Components Letters*, Vol. 15, No. 11, page 733-735, Nov. 2005, A 1-*V Transformer-Feedback Low-Noise Amplifier for* 5-*GHz Wireless LAN* in 0.18-μm *CMOS* published in *Journal of Solid-State Circuit*, Vol. 38, No. 3, page 427-435, Mar. 2003, of the Institute of Electrical and Electronic Engineers (IEEE); Paper No. FA8.6, entitled *A Fully Integrated CMOS* 900 *MHz LNA utilizing Monolithic Transformers*, of the International Solid-State Circuits Conference (ISSCC98); and U.S. Patent Publication No. 4,816,784, U.S. Patent Publication No. 6,577,219, U.S. Patent Publication No. 6,608,364, and U.S. Patent Publication No. 6,927,664.

SUMMARY OF THE INVENTION

Accordingly, one objective of the present invention is to provide a transformer to increase the coupling factor value of a transformer via plural protruding portions of the windings.

Another objective of the present invention is to provide a method of manufacturing the transformer with a high coupling factor value.

In accordance with the aforementioned and other objectives of the present invention, a transformer comprising a primary winding and a secondary winding is provided. The secondary winding is adjacent to the primary winding. The secondary winding and the primary winding induct with each other. The primary winding comprises a plurality of first protruding portions, and the secondary winding comprises a plurality of second protruding portions. The first protruding portions stretch to the secondary winding without electro-contact, and the second protruding portions stretch to the primary winding without electro-contact.

According to another aspect of the present invention, a transformer comprising a primary winding and a secondary winding is provided. The secondary winding is adjacent to the primary winding. The secondary winding and the primary winding induct with each other. The primary winding comprises a plurality of first protruding portions and a plurality of first openwork slots. The secondary winding comprises a plurality of second protruding portions and a plurality of second openwork slots. The first protruding portions stretch to the second openwork slots of the secondary winding, and the first protruding portions do not electrically contact the secondary winding. The second protruding portions stretch to the first openwork slots of the primary winding, and the second protruding portions do not electrically contact the primary winding.

According to another aspect of the present invention, a method of manufacturing a transformer is provided. First, a primary winding is formed substantially on a first plane. Next, a plurality of first protruding portions and a plurality of second protruding portions are formed above the primary winding. Next, a secondary winding is formed substantially on a second plane. The primary winding comprises a plurality of openwork slots, and the secondary winding comprises a plurality of second openwork slots. The first protruding portions are disposed on the primary winding, and the first ends of the first protruding portions are electrically connected to the primary winding. The second ends of the first protruding portions are disposed on the second openwork slots, and the first protruding portions are not electrically connected to the secondary winding. The first ends of the second protruding portions are disposed in the first openwork slots, and the second protruding portions are not electrically connected to the primary winding. The second ends of the second protruding portions are electrically connected to the secondary winding.

According to an embodiment of the present invention, the shape of the first protruding portions and the second protruding portions include cuboid, cylinder, or column.

According to an embodiment of the present invention, the first protruding portions and the second protruding portions are respectively arranged on the primary and secondary windings in a single row or in multiple rows.

According to an embodiment of the present invention, the first protruding portions and the second protruding portions are interdigitated with one another.

According to an embodiment of the present invention, the primary winding is substantially disposed on a first plane, and the secondary winding is substantially disposed on a second plane, wherein the first plane is parallel to the second plane.

According to an embodiment of the present invention, each of the first protruding portions extends into one of the second openwork slots in one-to-one manner, and each of the second protruding portions extends into one of the first openwork slots in one-to-one manner.

The present invention further provides a transformer, which includes a primary winding and a secondary winding. The primary winding includes a plurality of protruding portions. The secondary winding includes a plurality of openwork slots. The secondary winding is adjacent to the primary winding, and the secondary winding and the primary winding induct with each other. The protruding portions stretch to the openwork slots of the secondary winding, and the primary winding does not electrically contact the secondary winding.

According to an embodiment of the present invention, the primary winding is substantially disposed on a first and a third planes, and the secondary winding is substantially disposed on a second plane. The second plane is located between the first plane and the third plane, and the three planes are parallel one another.

The present invention further provides a method of manufacturing a transformer, which includes the following steps. First, a part of electrical path of the primary winding is substantially formed on the first plane. Then, a plurality of protruding portions is formed on the part of the electrical path of the first winding, wherein the protruding portions are electrically connected to the primary winding. Next, a secondary winding is substantially formed on a second plane. A plurality of openwork slots is formed on the secondary winding, wherein the protruding portions penetrate the openwork slots and are not electrically connected with the secondary winding. Another part of electrical path of the primary winding is substantially formed on the third plane. The first winding is formed by the electrical connection of the protruding portions and the electrical paths of the first and the third planes. The second plane is located between the first plane and the third plane, and the three planes are parallel one another.

In the present invention, a plurality of protruding portions is formed between the primary winding and the secondary winding to efficiently increase the coupling factor k of the transformer, thereby improving the energy (or signal) conversion rate and reducing energy (or signal) loss.

In order to make the aforementioned and other objects, features and advantages of the present invention comprehensible, preferred embodiments accompanied with figures are described in detail below.

DESCRIPTION OF EMBODIMENTS

Figure 1A:
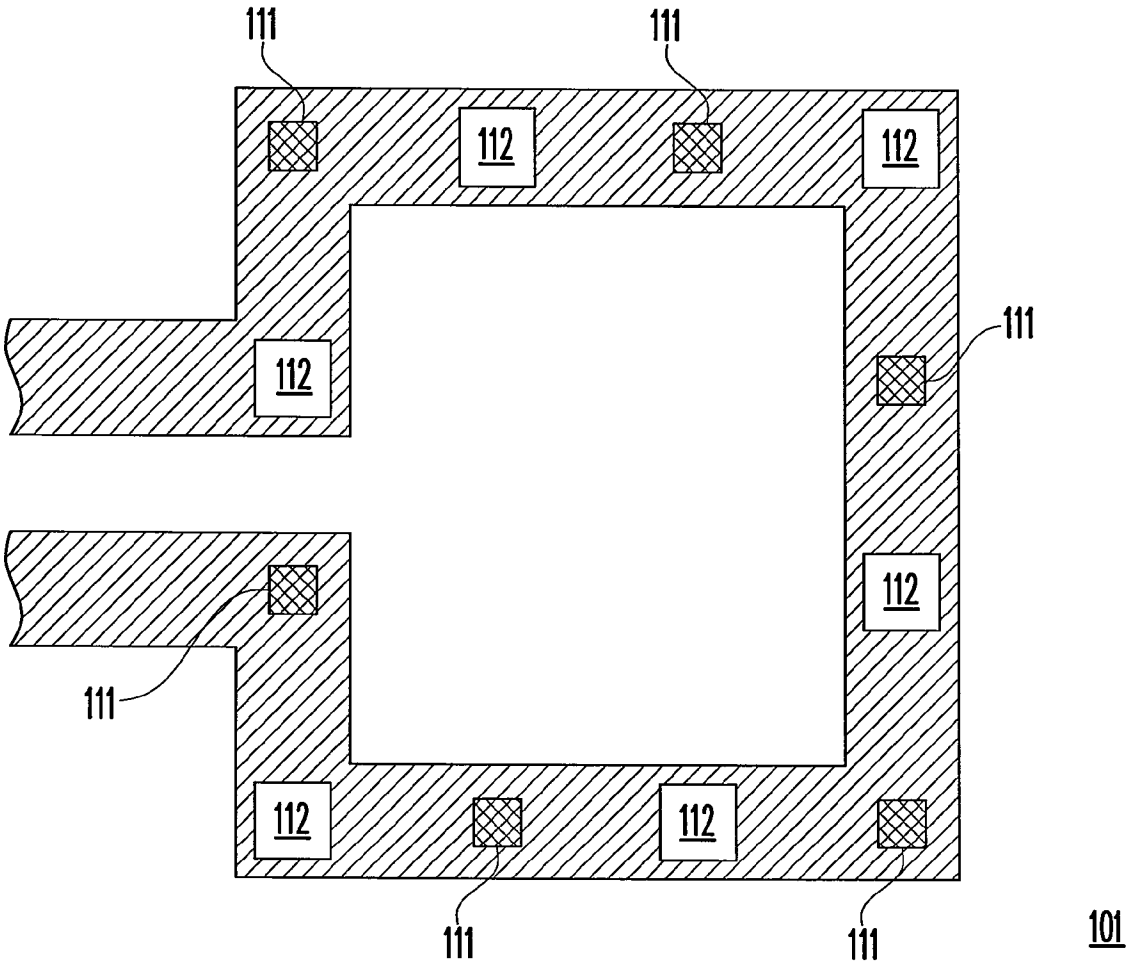
FIG. 1A is a top view of a primary winding of a high coupling factor transformer according to an embodiment of the present invention.
Figure 1B:
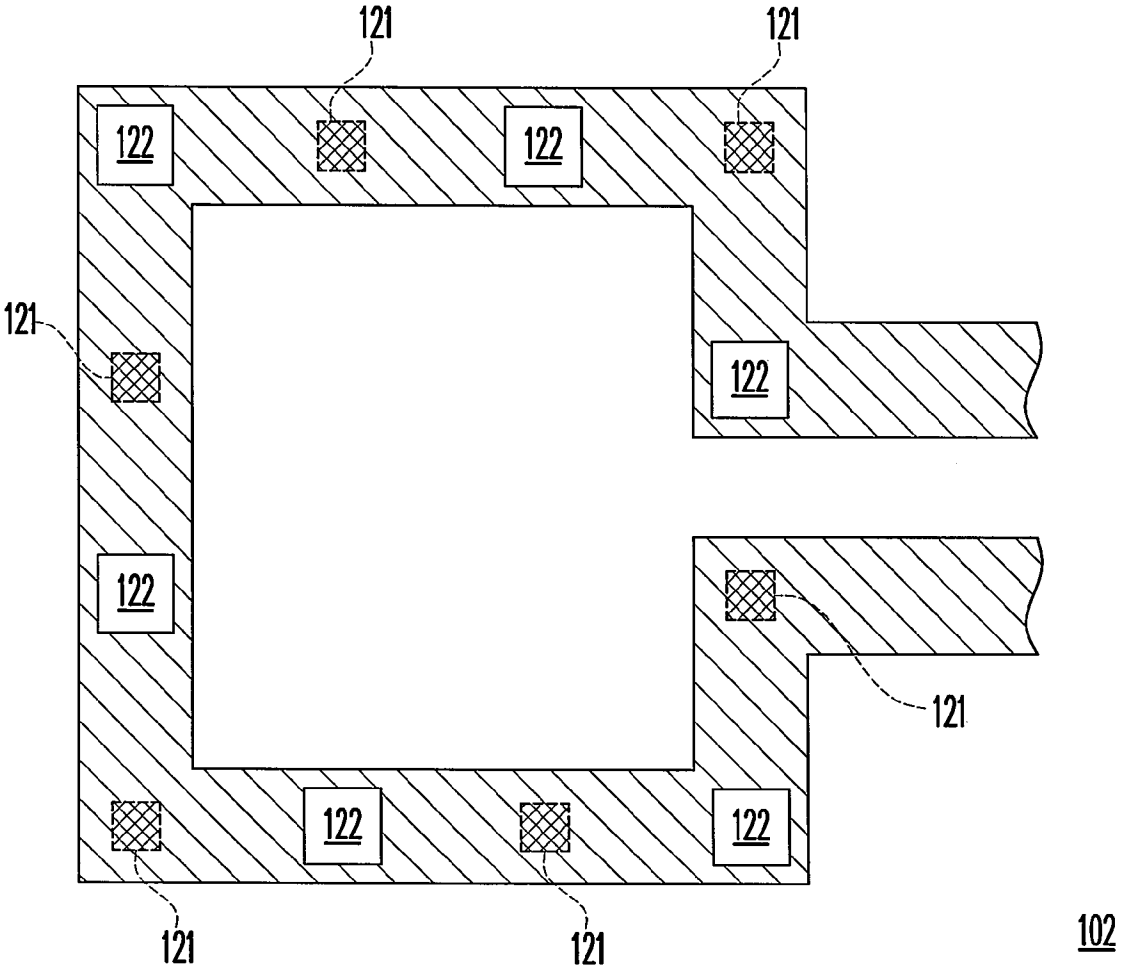
FIG. 1B is a top view of a secondary winding of a high coupling factor transformer according to an embodiment of the present invention.
Figure 1C:
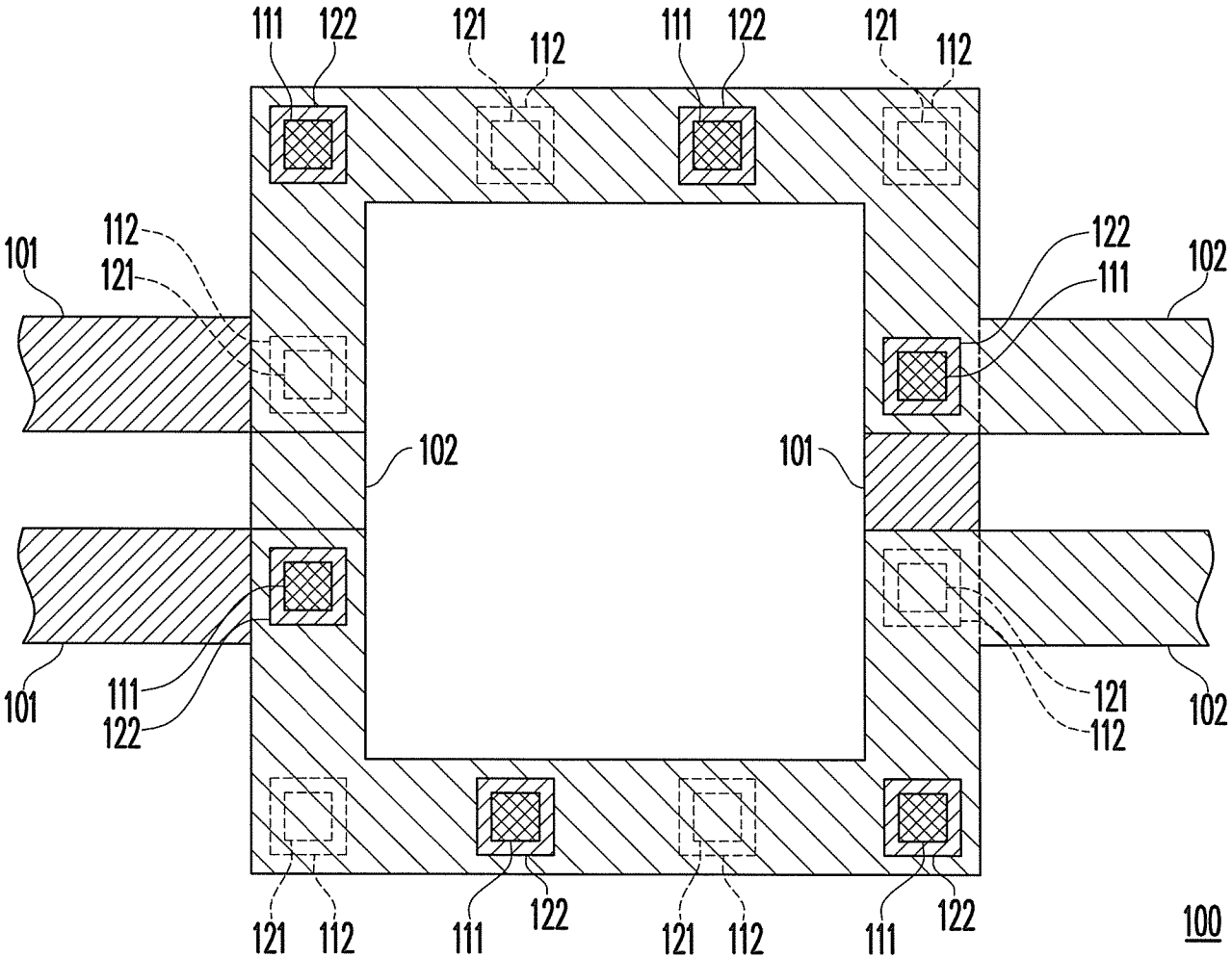
FIG 1C is a top view of an entire high coupling factor transformer according to an embodiment of the present invention.
Figure 1D:
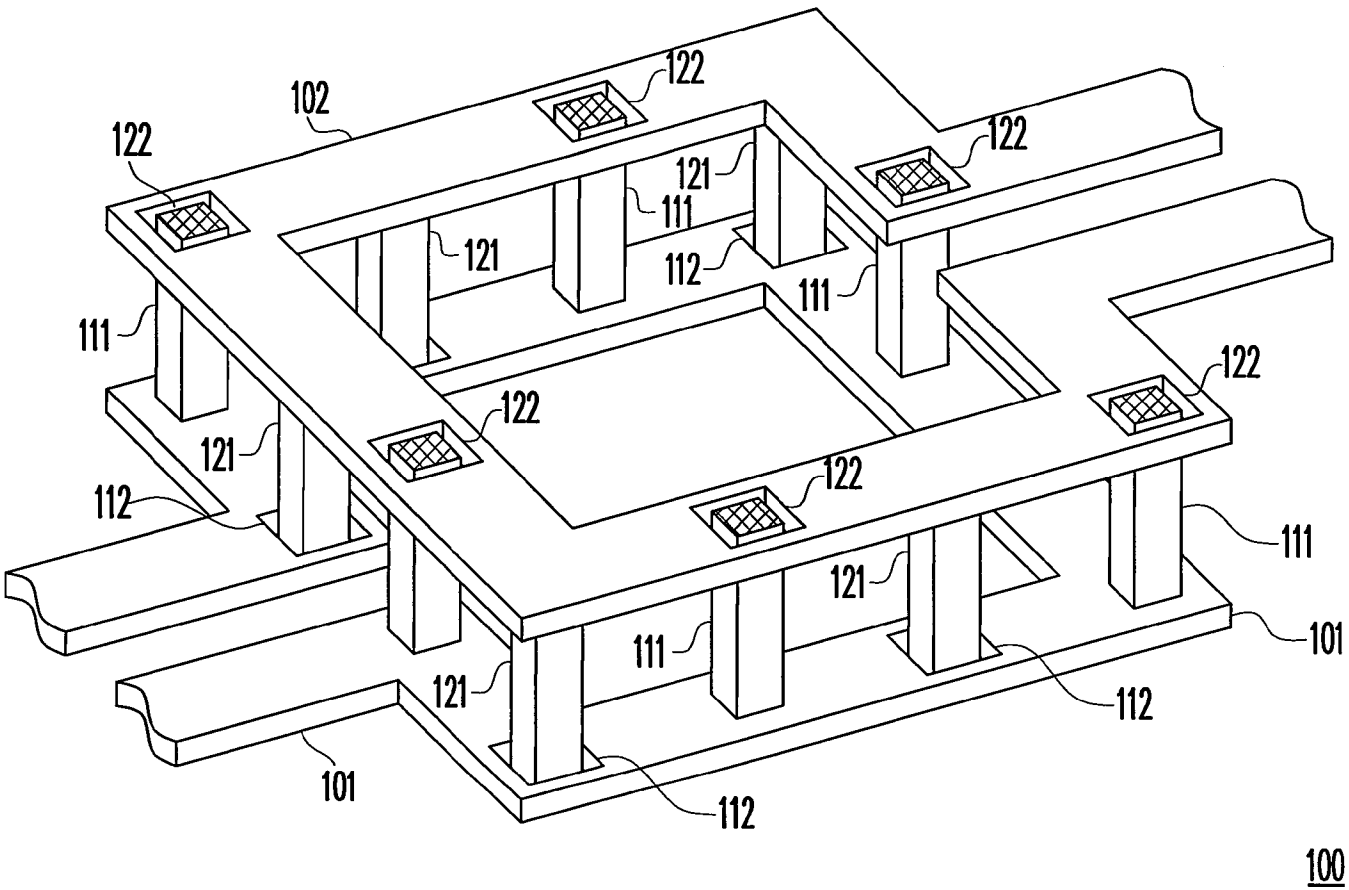
FIG. 1D is a stereogram of a high coupling factor transformer according to an embodiment of the present invention.

FIGS. 1A-1D show a high coupling factor transformer according to an embodiment of the present invention. FIG. 1A is a top view of a primary winding 101 of a high coupling factor transformer 100 according to an embodiment of the present invention, FIG. 1B is a top view of a secondary winding 102 of the high coupling factor transformer 100, FIG. 1C is a top view of the entire high coupling factor transformer 100 which is formed by stacking the secondary winding 102 above the primary winding 101, and FIG. 1D is a stereogram of the entire high transformer 100.

Referring to FIGS. 1A-1D, the transformer 100 comprises a primary winding 101 and a secondary winding 102. The secondary winding 102 is adjacent to the primary winding 101, and the primary winding 101 and the secondary winding 102 induct with each other. In the present embodiment, the primary winding 101 of the transformer 100 is substantially disposed on a first plane, and the secondary winding 102 is substantially disposed on a second plane, wherein the first plane is parallel to the second plane. If the first plane is the fourth metal layer, the second plane is the fifth metal layer. Those of ordinary skill in the art would appreciate that the primary winding 101 and the secondary winding 102 may also be disposed on any two metal layers in an integrated circuit as required.

The primary winding 101 comprises a plurality of first protruding portions 111 and a plurality of first openwork slots 112. The first protruding portions 111 are disposed on the primary winding 101, and the first end of each of the first protruding portions is electrically connected to the primary winding 101. The secondary winding 102 comprises a plurality of second protruding portions 121 and a plurality of second openwork slots 122. The second protruding portions 121, indicated by dashed-line frames in FIG. 1B, are disposed under the secondary winding 102. The second protruding portions 121 extend from the secondary winding 102 to the primary winding 101. The first ends of the second protruding portions 121 are disposed in the first openwork slots and the second protruding portions 121 are not electrically connected to the primary winding 101. The second ends of the second protruding portions 121 are electrically connected to the secondary winding 102. The first protruding portions 111 extend to the secondary winding 102. The arrangement position of the second openwork slots 122 can just accommodate the second ends of the first protruding portions 111, and the first protruding portions 111 are not electrically connected to the secondary winding 102. The first protruding portions 111 and the second protruding portions 121 can be achieved by vias. The first protruding portions 111 and the second protruding portions 121 can be conductors having cuboidal shape, cylindrical shape, or other geometrical shapes. In the present embodiment, the first protruding portions 111 and the second protruding portions 121 are respectively arranged in the primary winding 101 and the secondary winding 102 in a single row. As shown in the figure, the first protruding portions 111 and the second protruding portions 121 are interdigitated with one another between the primary winding 101 and the secondary winding 102.

Each of the protruding portions extends into one of the openwork slots in "one-to-one" manner, but the implementation of the present invention is not limited as such. For example, a designer can make two or more protruding portions extend into one openwork slot.

Figure 2:
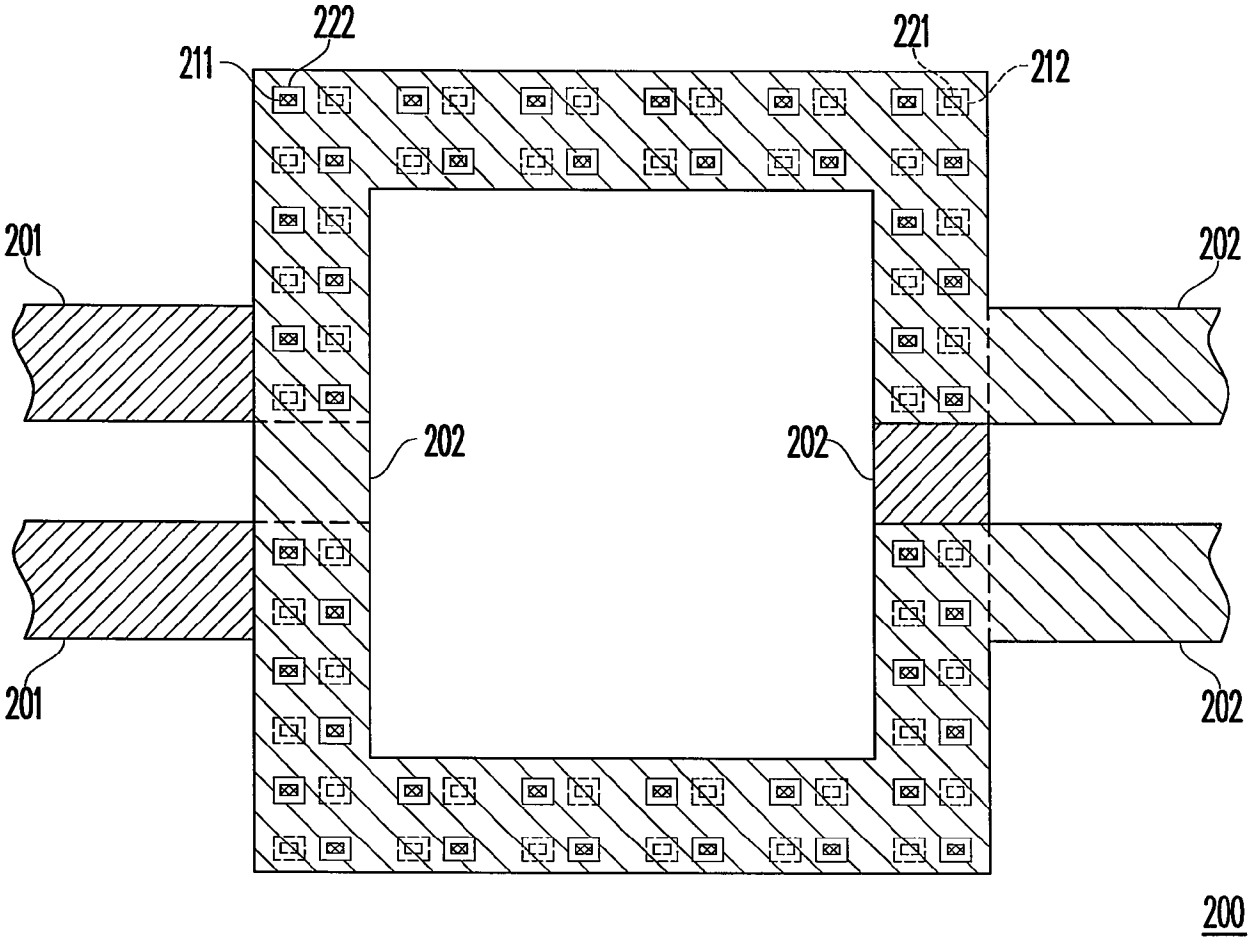
FIG. 2 is a top view of a transformer according to another embodiment of the present invention.

In the transformer, the arrangement of the protruding portions of the primary winding and the secondary winding is not limited to those described in the above embodiment. Those of ordinary skill in the art would appreciate that the protruding portions of the primary winding and the secondary winding may be arranged in a single row, double rows, multiple rows, or in other geometrical arrangements. FIG. 2 is a top view of the transformer according to another embodiment of the present invention. The transformer 200 is formed by stacking the secondary winding 202 above the primary winding 201. The present embodiment is similar to the embodiment described above, those not described in the present embodiment can be implemented with reference to the above embodiment. The primary winding 201 of the transformer 200 is substantially disposed on the first plane, and the secondary winding 202 is substantially disposed on the second plane, wherein the first plane is parallel to the second plane. The primary winding 201 comprises a plurality of first protruding portions 211 and a plurality of first openwork slots 212. The first protruding portions 211 are disposed on the primary winding 201 and the first end of each of the protruding portions 211 is electrically connected to the primary winding 201. The secondary winding 202 comprises a plurality of second protruding portions 221 and a plurality of second openwork slots 222. In the present embodiment, the first protruding portions 211 and the second protruding portions 221 are arranged in double rows and interdigitated with one another between the primary winding 101 and the secondary winding 102.

Figure 3A:
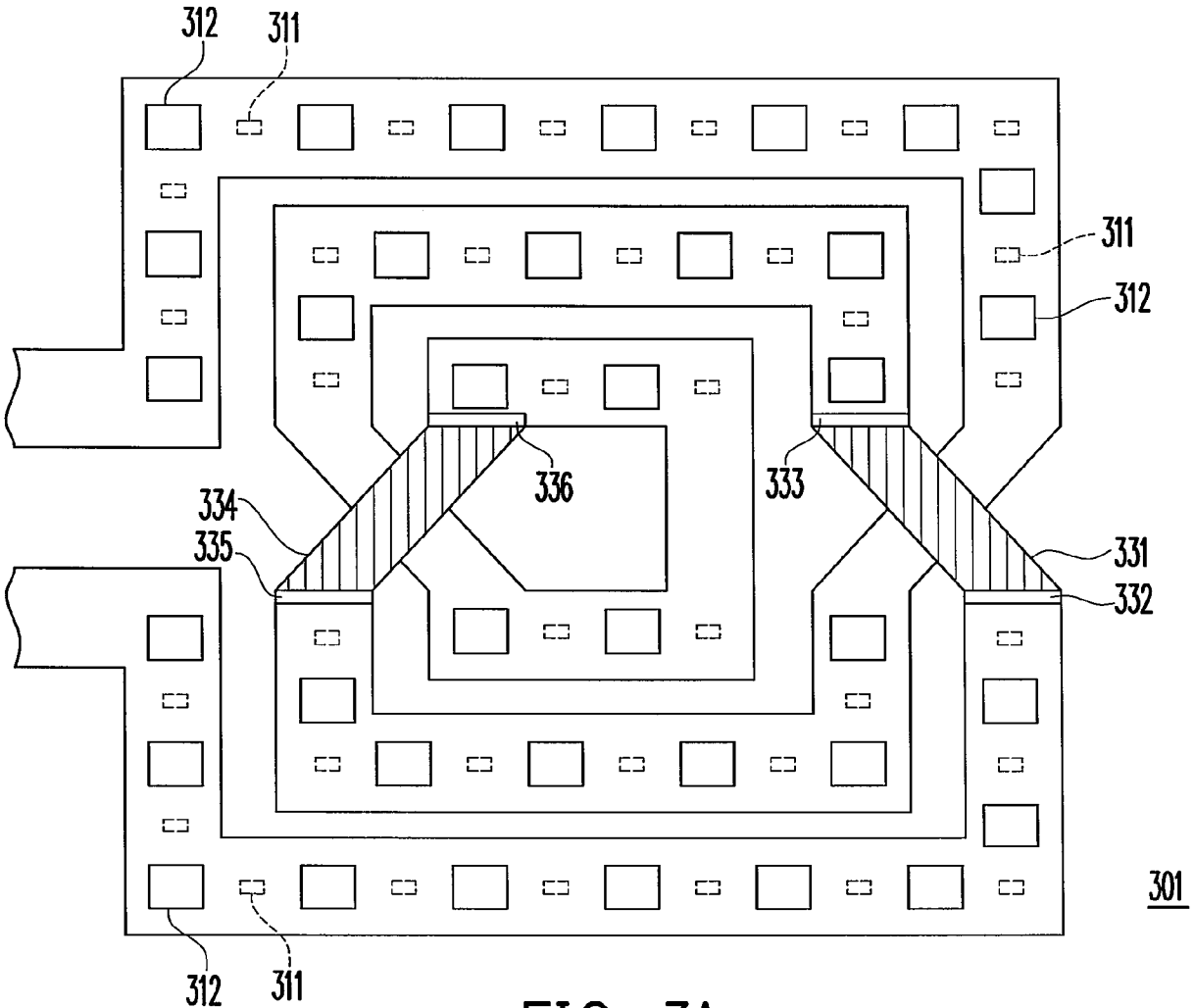
FIG. 3A is a top view of the primary winding of a high coupling factor transformer according to another embodiment of the present invention.
Figure 3B:
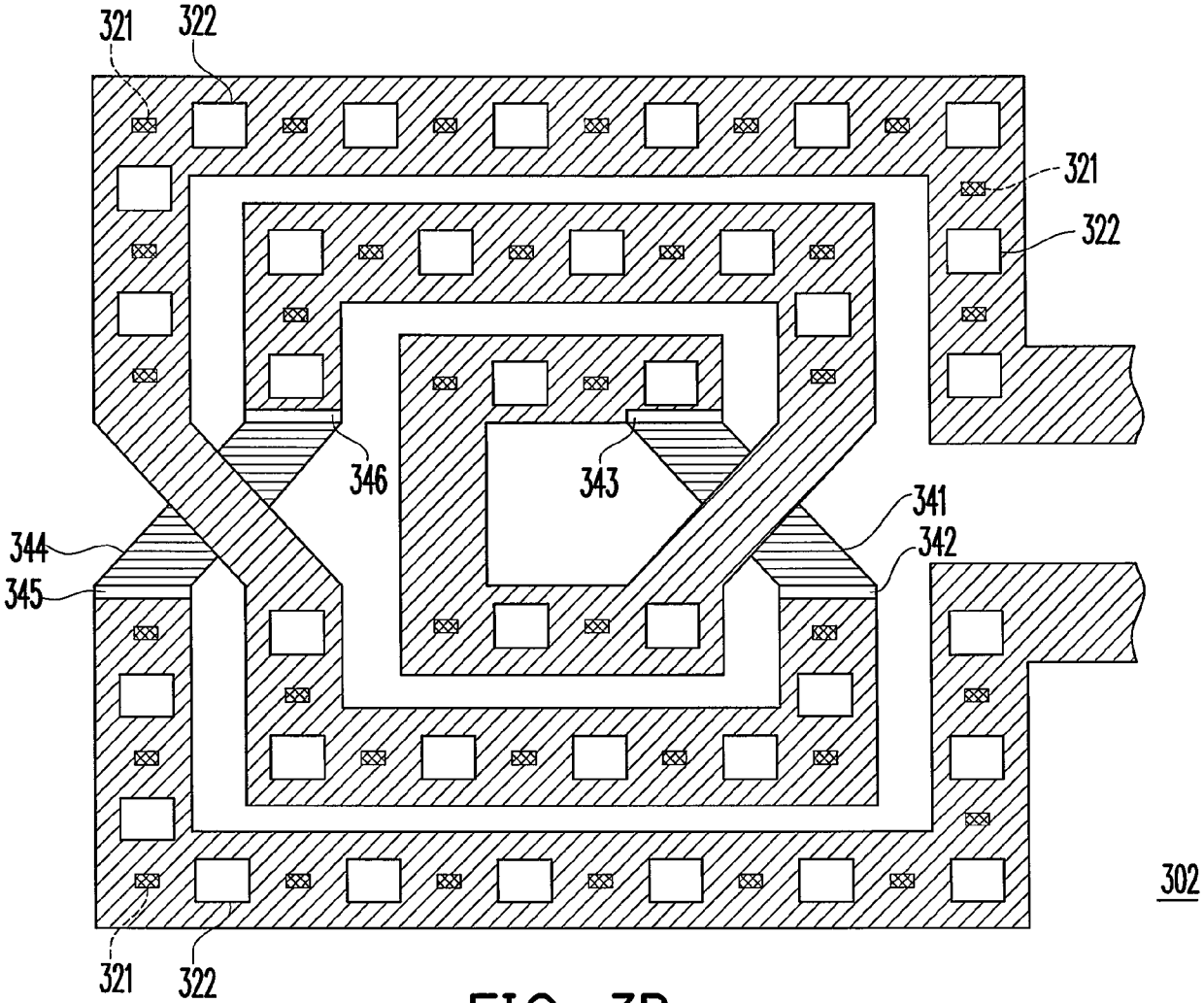
FIG. 3B is a top view of the secondary winding of a high coupling factor transformer according to another embodiment of the present invention.
Figure 3C:
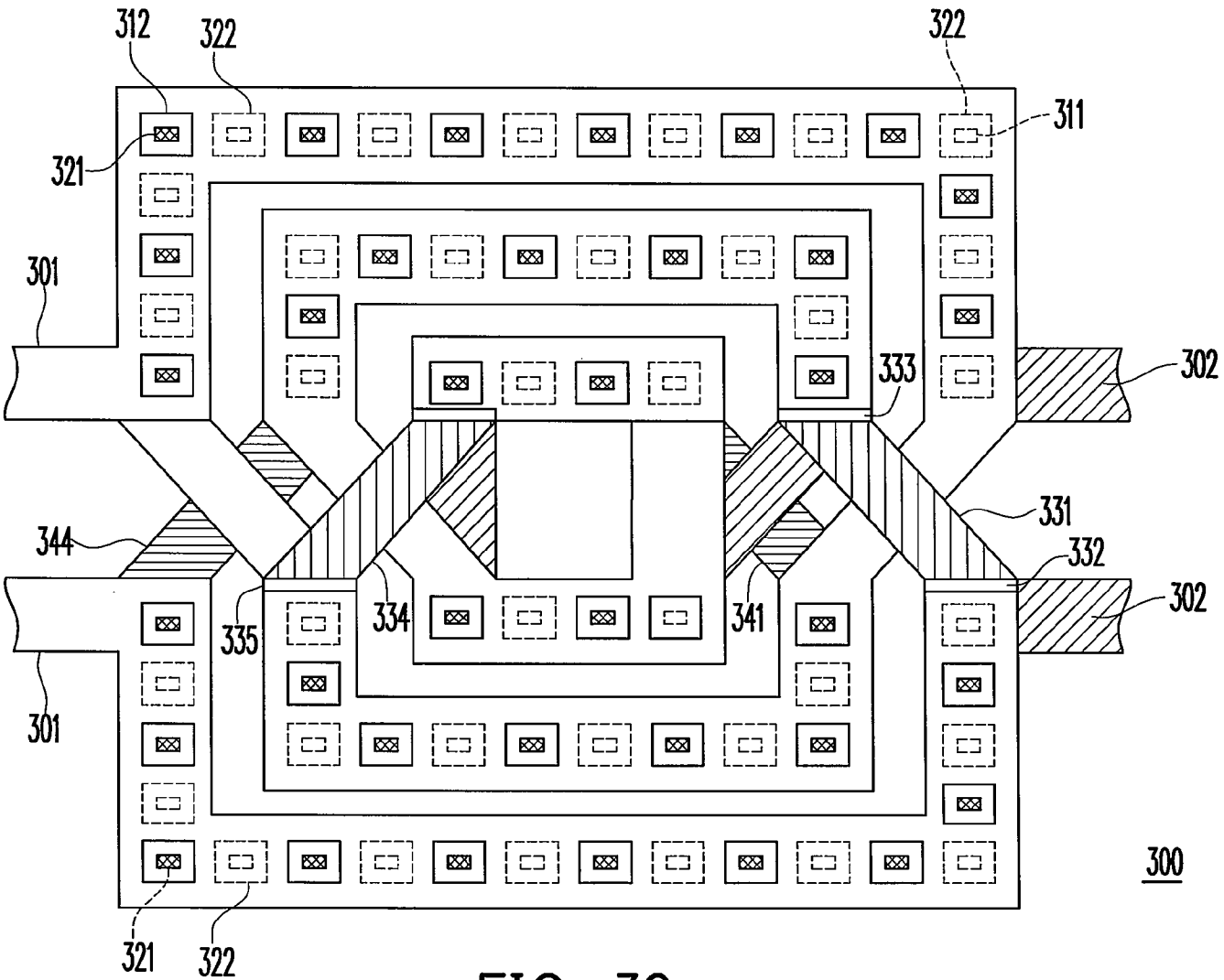
FIG. 3C is a top view of the entire high coupling factor transformer according to another embodiment of the present invention.

The number of turns of the primary winding and the secondary winding are not limited. Those of ordinary skill in the art would appreciate that the transformer may be implemented in any number of turns as required. FIG. 3A-3C are top views of a high coupling factor transformer according to another embodiment of the present invention. The transformer 300 is formed by stacking a primary winding 301 above a secondary winding 302. FIG. 3A is a top view of the primary winding 301 of the high coupling factor transformer 300 according to another embodiment of the present invention. FIG. 3B is a top view of the secondary winding 302 of the high coupling factor transformer 300 according to another embodiment of the present invention. FIG. 3C is a top view of the entire high coupling factor transformer 300 according to another embodiment of the present invention. Those not described in the present embodiment can be implemented with reference to the above embodiment.

Referring to FIGS. 3A-3C, the transformer 300 comprises the primary winding 301 and the secondary winding 302. The secondary winding 302 is adjacent to the primary winding 301, and the secondary winding 302 and the primary winding 301 induct with each other. In the present embodiment, the primary winding 301 of the transformer 300 is substantially disposed on the first plane and the secondary winding 302 is substantially disposed on the second plane, wherein the first plane is parallel to the second plane.

Referring to FIG. 3A, the primary winding 301 is substantially disposed on the first plane. Since the primary winding 301 is a planar inductor with three turns, a part of electrical paths (such as electrical paths 331 and 334) in the primary winding 301 must be disposed on other planes. For example, if the first plane is the fourth metal layer, a part of the electrical paths 331 and 334 of the primary winding 301 can be disposed on the fifth metal layer. The electrical path 331 can be electrically connected to the primary winding 301 through the vias 332 and 333. Additionally, the electrical path 334 can also be electrically connected to the primary winding 301 through the vias 335 and 336. The primary winding 301 comprises a plurality of first protruding portions 311 and a plurality of first openwork slots 312. The first protruding portions 311, indicated by dashed-line frames in FIG. 3A, are disposed under the secondary winding 301, and the first end of each of the first protruding portions 311 is electrically connected to the primary winding 301.

Referring to FIG. 3B, the secondary winding 302 is substantially disposed on the second plane. Since the secondary winding 302 is also a planar inductor with three turns, a part of electrical paths (such as electrical paths 341 and 344) in the secondary winding 302 must be disposed on other planes. For example, if the second plane is the third metal layer, a part of the electrical paths 341 and 344 of the secondary winding 302 are disposed on the second metal layer. The electrical path 341 can be electrically connected to the secondary winding 302 through the vias 342 and 343. Additionally, the electrical path 344 can also be electrically connected to the secondary winding 302 through the vias 345 and 346. Those of ordinary skill in the art would appreciate that the primary winding 301 and the secondary winding 302 may be disposed on any two metal layers in an integrated circuit as required.

Referring to FIGS. 3A-3C, the secondary winding 302 comprises a plurality of second protruding portions 321 and a plurality of second openwork slots 322. The second protruding portions 321 are disposed on the secondary winding 302. The second protruding portions 321 extend from the secondary winding 302 to the primary winding 301. The first ends of the second protruding portions 321 are disposed in the first openwork slots 312, and the second protruding portions 312 are not electrically connected to the primary windings 301. The second ends of the second protruding portions 312 are electrically connected to the secondary winding 302. The first protruding portions 311 extend to the secondary winding 302. The arrangement position of the second openwork slots 322 can just accommodate the second ends of the first protruding portions 311, and the first protruding portions 311 are not electrically connected to the secondary windings 302. The first protruding portions 311 and the second protruding portions 321 can be achieved by vias. The first protruding portions 311 and the second protruding portions 321 can be conductors of cuboidal shape, cylindrical shape, or other geometrical shapes. In the present embodiment, the first protruding portions 311 and the second protruding portions 321 are respectively arranged on the primary winding 301 and the secondary winding 302 in a single row. As shown in the figure, the first protruding portions 311 and the second protruding portions 321 are interdigitated with one another between the primary winding 301 and the secondary winding 302.

Each of the protruding portions extends into one of the openwork slots in "one-to-one" manner in the above embodiment, but the implementation of the present invention is not limited to this. For example, a designer can make two or more protruding portions extend into one openwork slot. In the transformer, the arrangement of the protruding portions of the primary winding and the secondary winding is not limited to those described in the above embodiment. Those of ordinary skill in the art would appreciate that the protruding portions of the primary winding and the secondary winding may be arranged in a single row, double rows, multiple rows, or in other geometrical arrangements.

The method of manufacturing the transformer comprises forming the primary winding substantially on the first plane, wherein the primary winding comprises a plurality of first openwork slots. Then, a plurality of first protruding portions and a plurality of second protruding portions are formed above the primary winding. Each of the first protruding portions is disposed on the primary winding and the first end of each of the first protruding portions is electrically connected to the primary winding. And the first ends of the second protruding portions are disposed in the first openwork slots, and each of the second protruding portions is not electrically connected to the primary winding. Finally, the secondary winding is substantially formed the second plane, wherein the secondary winding comprises a plurality of second openwork slots. The second openwork slots are disposed on the second ends of the first protruding portions, and each of the first protruding portions is not electrically connected to the secondary winding. The second ends of the second protruding portions are electrically connected to the secondary winding.

In the present invention, the first and second protruding portions can have a cuboidal shape, cylindrical shape, or other columnar shape. The first and second protruding portions can be arranged in single row or multiple rows respectively on the primary winding and the secondary winding. The first protruding portions and the second protruding portions are interdigitated with one another between the primary winding and the secondary winding, or disposed between the primary winding and the secondary winding in other manners.

According to another embodiment of the present invention, the primary winding is substantially disposed on a first plane and the secondary winding is substantially disposed on a second plane, wherein the first plane is parallel to the second plane.

According to another embodiment of the present invention, each of the first protruding portions extends into one of the second openwork slots in one-to-one manner, and each of the second protruding portions extends into one of the first openwork slots in one-to-one manner. However, a designer can make two or more protruding portions stretch into one openwork slot.

Figure 4A:
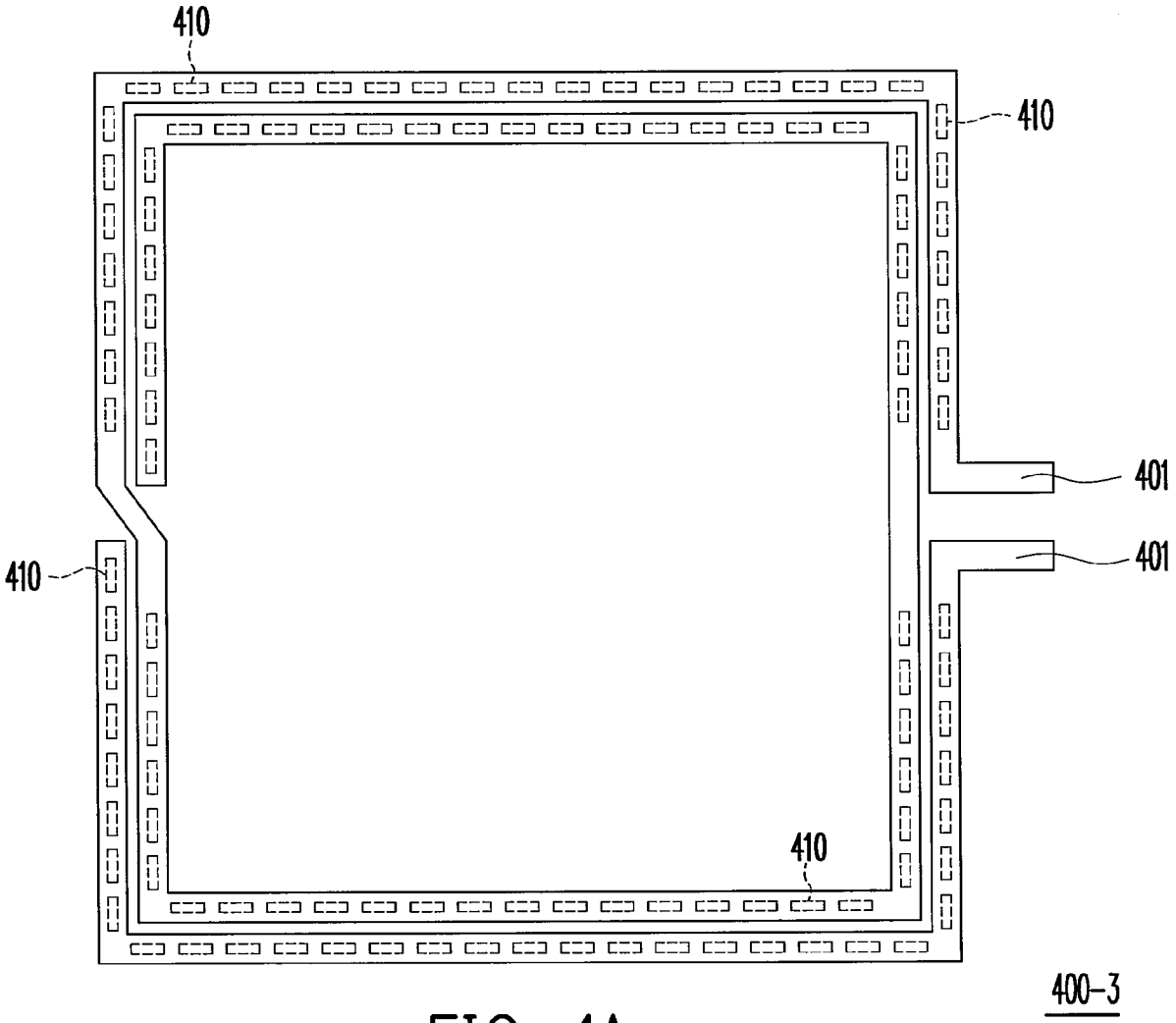
FIG. 4A~4D are top views of another high coupling factor transformer according to an embodiment of the present invention.
Figure 4B:
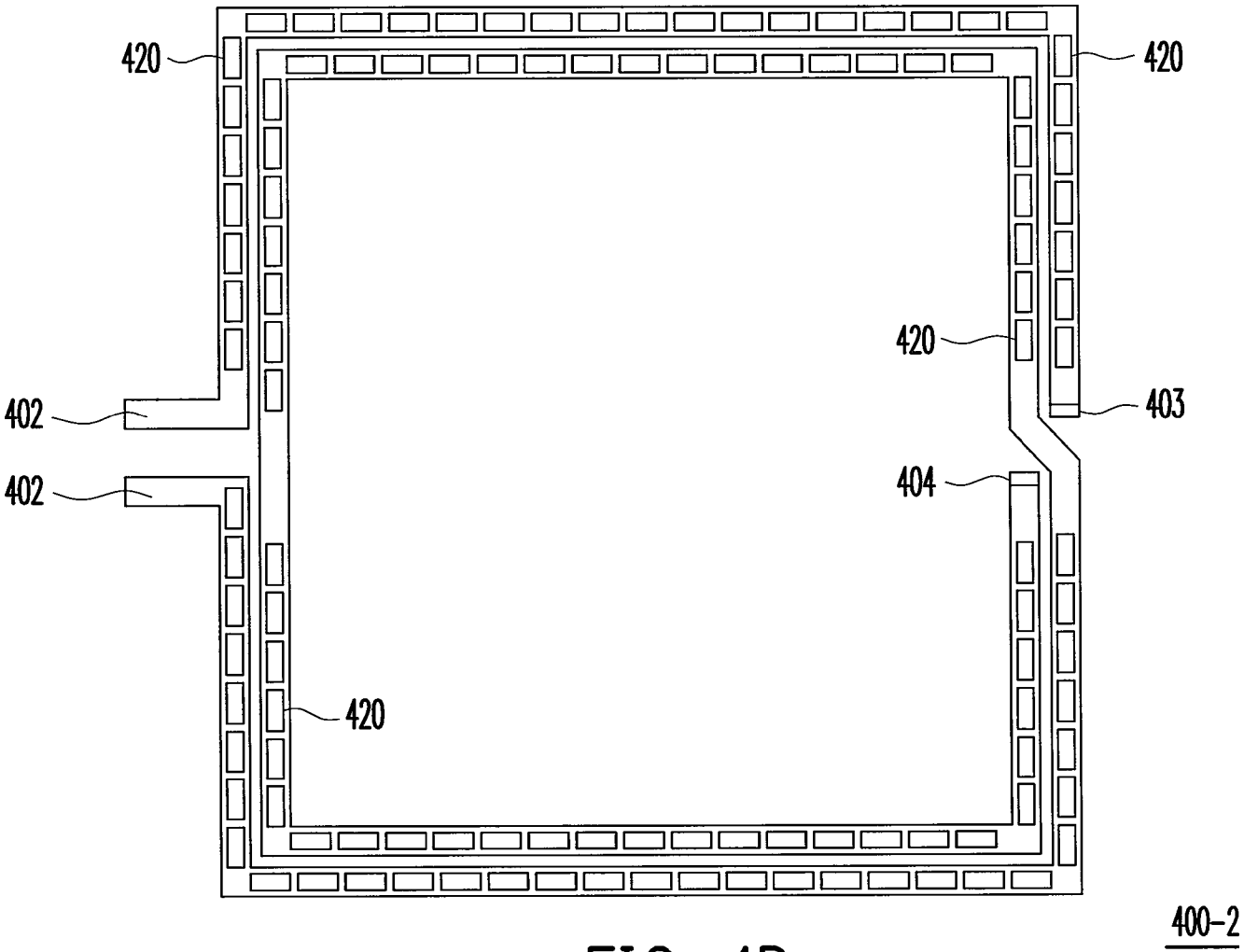
Figure 4C:
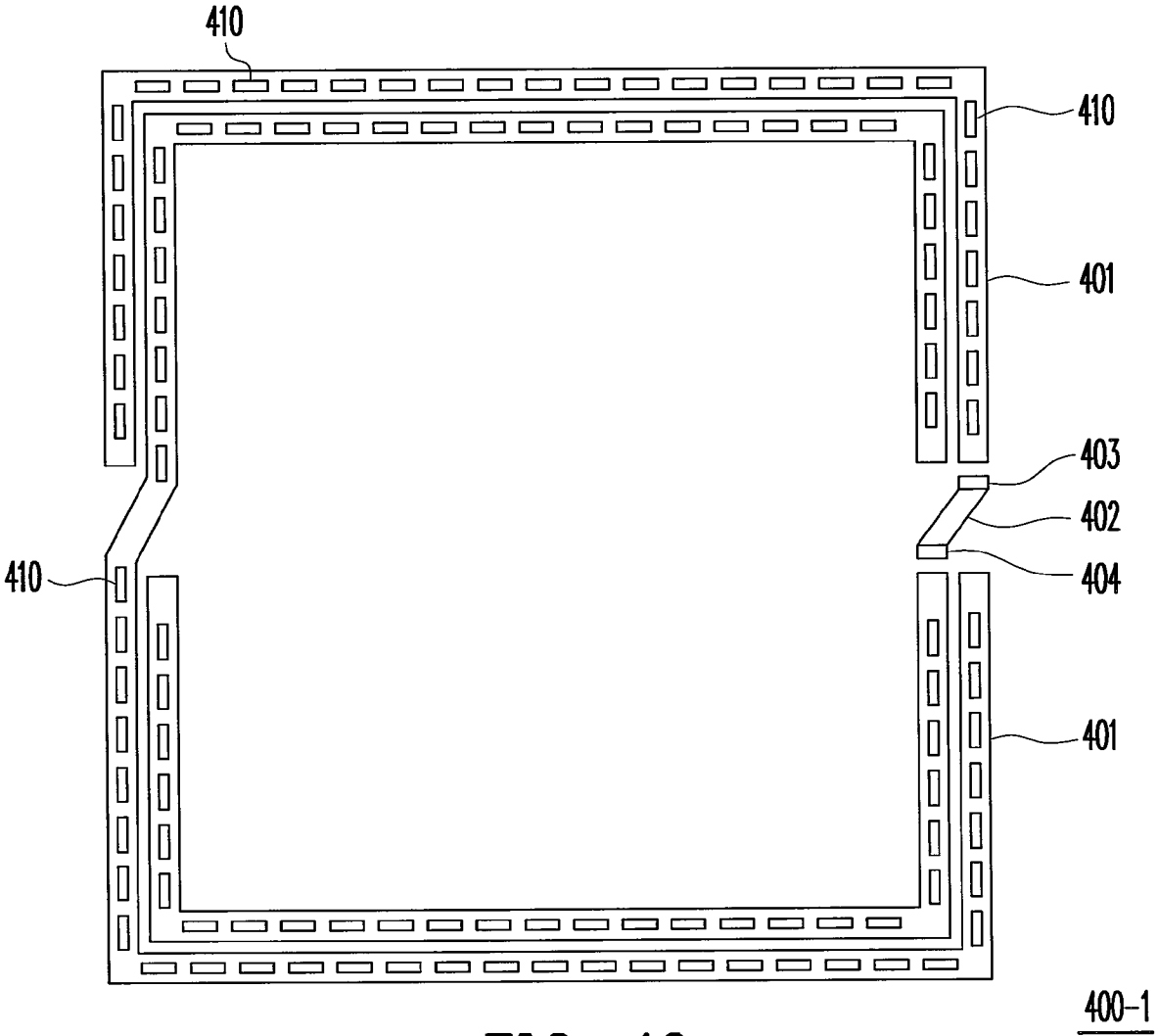
Figure 4D:
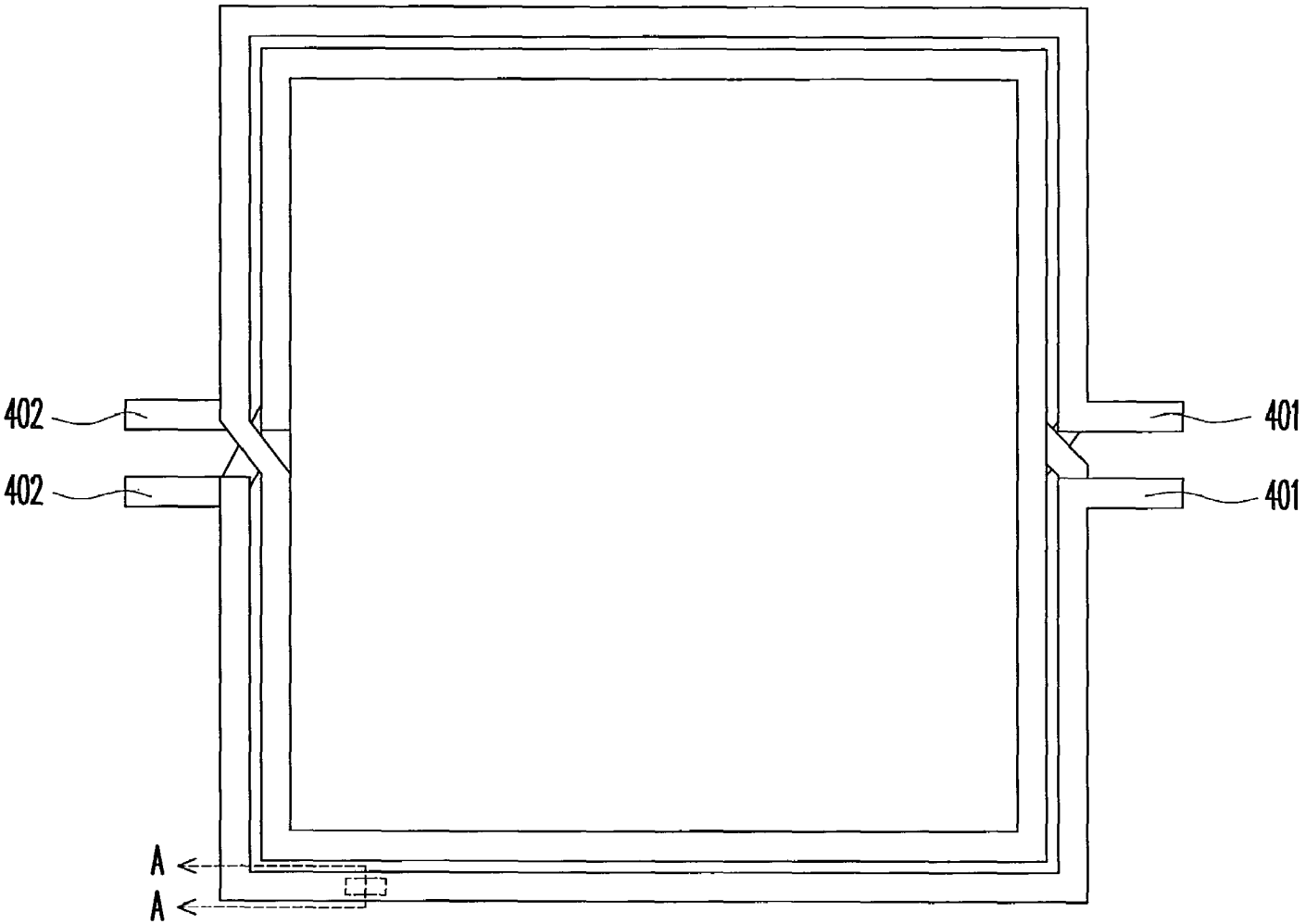

Those skilled in the art shall be able to implement the present invention by using other embodiments according to the spirit, teachings and suggestions of the present invention described above. For example, FIG. 4A~4C are top views of another high coupling factor transformer according to an embodiment of the present invention. The transformer 400 includes the primary winding 401 and the secondary winding 402. Wherein, FIG. 4A illustrates the layout of the third plane 400-3 of the transformer 400, FIG. 4B illustrates the layout of the second plane 400-2 of the transformer 400, and FIG. 4C illustrates the layout of the first plane 400-1 of the transformer 400. The primary winding 401 of the transformer 400 is substantially disposed on the first plane 400-1 and the third plane 400-3, and the secondary winding 402 is substantially disposed on the second plane 400-2. Wherein, the second plane 400-2 is located between the first plane 400-1 and the third plane 400-3, and the three planes are parallel one another. The first plane 400-1, the second plane 400-2 and the third plane 400-3 can be any layer of the conductive layers, such as a metal layer or a polysilicon layer. For example, the first plane 400-1 is the sixth metal layer M6, the second plane 400-2 is the seventh metal layer M7, and the third plane 400-3 is the eighth metal layer M8. FIG. 4D is a top view of the entire transformer 400. Those not described in the present embodiment can be implemented with reference to the above-described embodiment.

Figure 5:
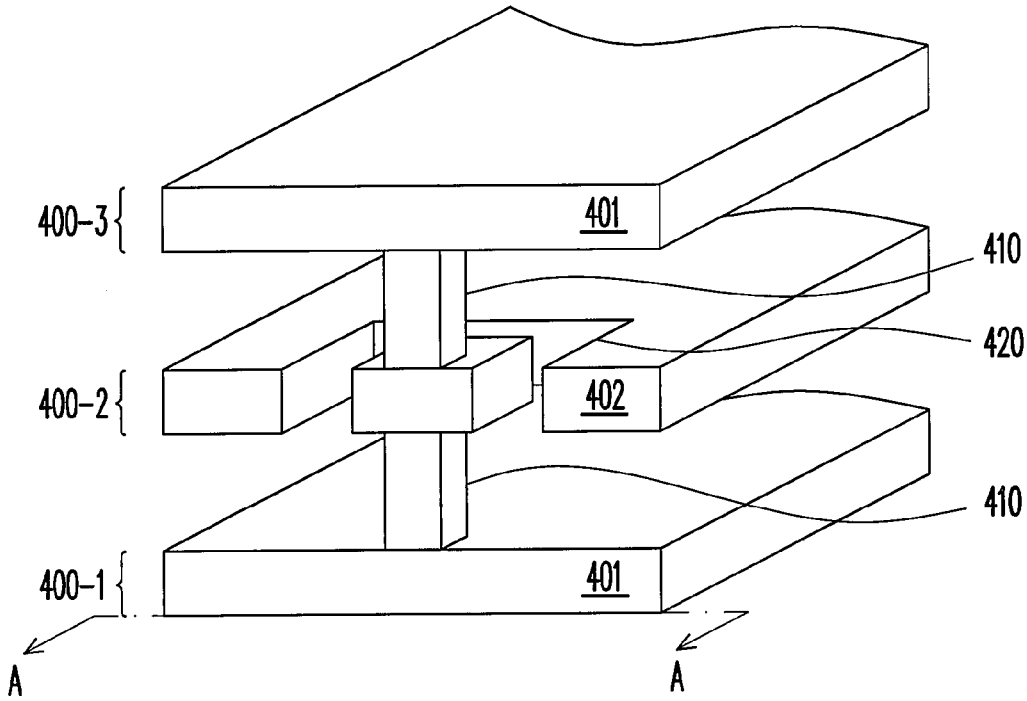
FIG. 5 is a stereogram illustrating the sectional view Line A of the protruding portions in the transformer in FIG. 4D.

The primary winding includes a plurality of protruding portions 410. The secondary winding includes a plurality of openwork slots 420. Wherein, the protruding portions 410 of the primary winding 401 extend to the openwork slots 420 of the secondary winding 402, and the primary winding and the secondary winding are not electrically connected. FIG. 5 is a stereogram illustrating the sectional view Line A of the protruding portions in the transformer in FIG. 4D. The electrical paths on the first plane 400-1 and the third plane 400-3 of the primary winding 401 are electrically connected through a plurality of the protruding portions 410. The protruding portions 410 penetrate the openwork slots 420, and the protruding portions 410 and the secondary winding 402 are not electrically connected. The protruding portions 410 can be achieved by vias. The protruding portions 410 can be conductors having cuboidal shape, cylindrical shape or other geometrical shapes, and the openwork slots can have any geometrical shapes.

In the present embodiment, the protruding portions 410 and the openwork slots 420 are respectively arranged on the primary winding 401 and the secondary winding 402 in a single row. However, the arrangement of the protruding portions 401 of the primary winding 401 and the openwork slots 402 of the secondary winding 402 is not limited to those described in the above embodiment. Those of ordinary skill in the art would appreciate that the protruding portions and the openwork slots may be arranged in a single row, double rows, multiple rows, or in other geometrical arrangements.

Though each of the protruding portions 410 extends into one of the openwork slots in one-to-one matter in the present embodiment, the implementation of the present invention should not be limited by this. A designer can make two or more protruding portions stretch into a same openwork slot.

Figure 6A:
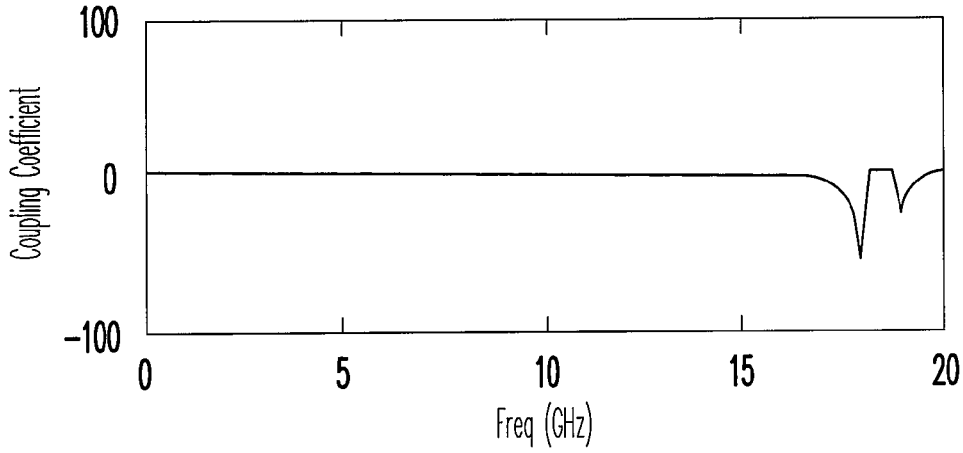
FIG. 6A illustrates the characteristic of the coupling factor k of the transformer 400 in FIG. 4D when the measured frequency is between 0-20GHz.
Figure 6B:
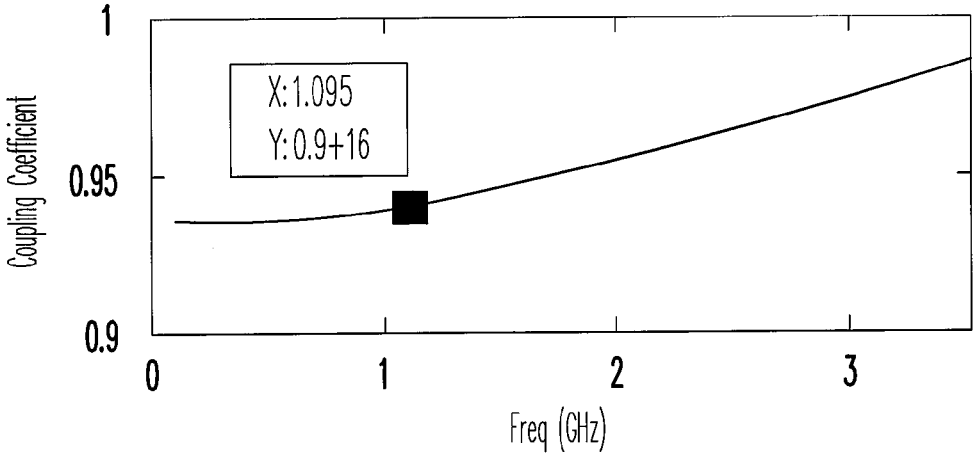
FIG. 6B illustrates the characteristic of the coupling factor k of the transformer in FIG. 6A when the frequency is ranged between 0-3.5GHz.
Figure 7:
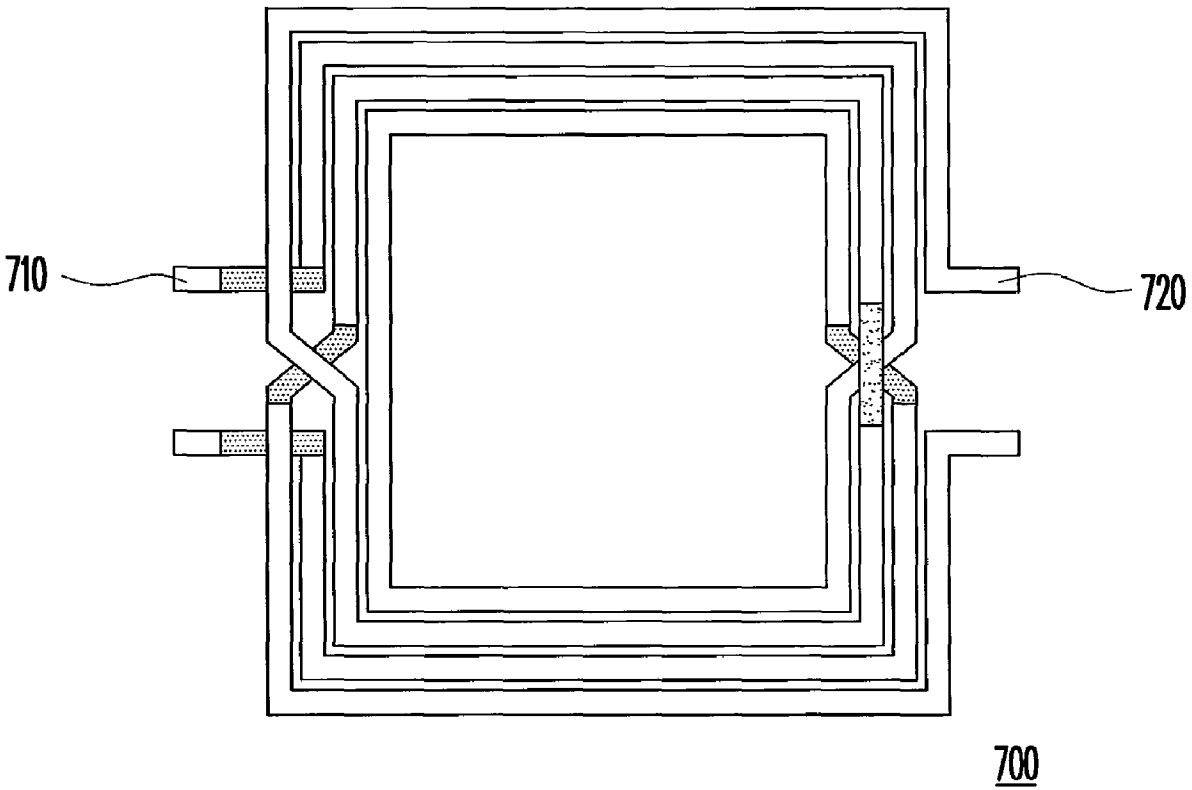
FIG. 7 (PRIOR ART)
FIG. 7 illustrates the layout of a general transformer.
Figure 8A:
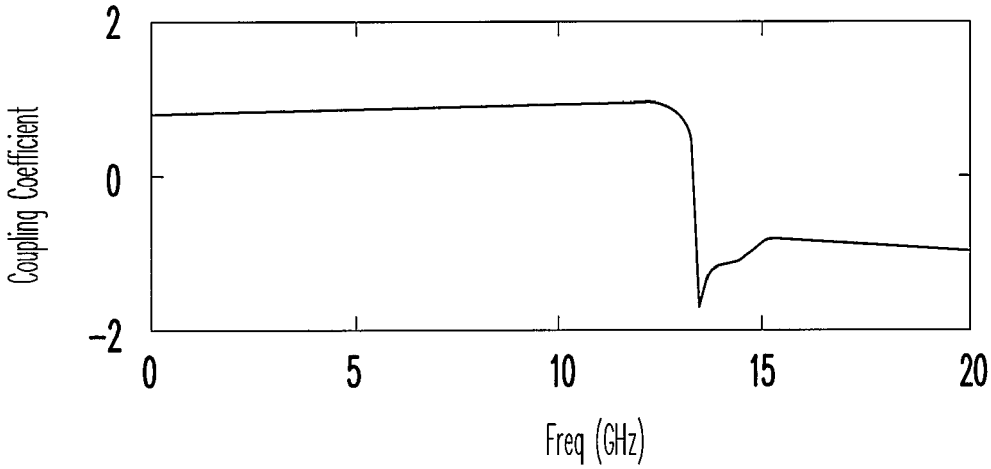
FIG. 8A(PRIOR ART)
FIG. 8A illustrates the characteristic of the coupling factor k of the transformer in FIG. 7.
Figure 8B:
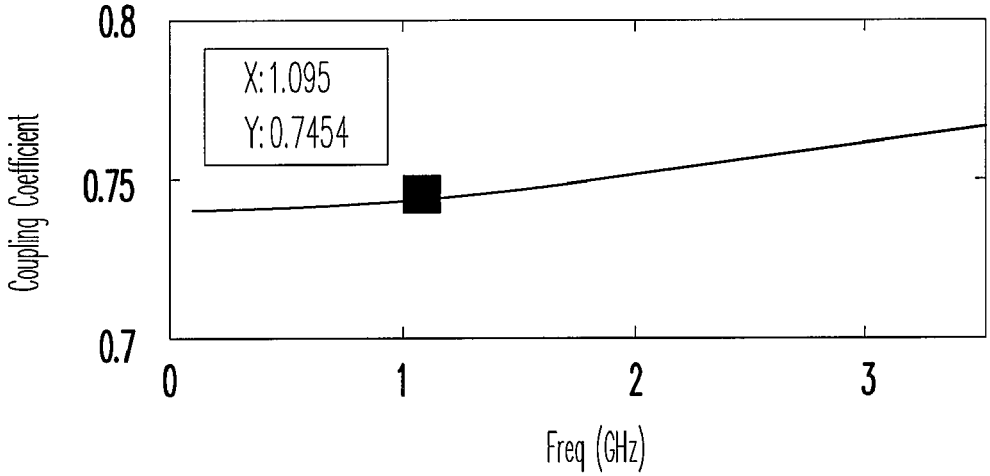
FIG. 8B(PRIOR ART)
FIG. 8B illustrates the characteristic of the coupling factor k of the transformer in FIG. 8A when the frequency is ranged between 0-3.5GHz.

Those skilled in the art can decide the turns, width and winding distance of the primary winding 401 and the secondary 402, and the outer diameter of the transformer 400 according to the practical requirements. To facilitate the comparison between the prior art and the present invention, the outer diameter of the transformer 400, the width and the winding distance are assumed 250 um, 9 um and 1.6 um respectively. The number of the turns of the primary winding 401 and the secondary winding 402 is 2, and the first plane 400-1, the second plane 400-2 and the third plane 400-3 are respectively M6, M7 and M8. FIG. 6A illustrates the characteristic of the coupling factor k of the transformer 400 in FIG. 4D when the measured frequency is between 0~20 GHz. FIG. 6B illustrates the characteristic of the coupling factor k of the transformer in FIG. 6A when the frequency is ranged between 0~3.5 GHz. It can be seen from FIG. 6B that the coupling factor k is about 0.942 when the transformer 400 is at the working frequency 1 GHz. Compared with the conventional transformer 700 in FIG. 7, the coupling factor k has been significantly increased.

An example of the manufacturing method of the transformer 400 is illustrated below. First, a part of electrical path (as shown in FIG. 4C) of the primary winding 401 and a part of electrical path of the secondary winding 402 are substantially formed on the first plane 400-1 (as shown in FIG. 4C). A plurality of protruding portions 410 is formed on the electrical path of the primary winding 401 of the first plane 400-1, wherein each protruding portion 410 is electrically connected to the electrical path of the primary winding 401 of the first plane 400-1. In addition, vias 403 and 404 are formed at two ends of the electrical path of the secondary winding 402 of the first plane 400-1.

Next, a secondary winding 402 is substantially formed on the second plane 400-2 (as shown in FIG. 4B). Wherein, two turns of winding are formed by the electrical connection between vias 403 and 404 and the electrical paths of the secondary winding 402 of the second plane 400-2. A plurality of openwork slots 420 is formed. The protruding portions 410 penetrate the openwork slots 420, and the protruding portions are not electrically connected with the secondary winding 402.

Then, another part of electrical path of the primary winding 401 is substantially formed on the third plane 400-3 (as shown in FIG. 4A). The first winding 401 is formed by the electrical connection of the protruding portions 410 and the electrical path of the first plane 400-1 and the third plane 400-3.

In the application of a transformer, the coupling factor k is quite an important parameter in circuit design. A high k value means a high energy (or signal) conversion rate and means that the energy (or signal) loss of the transformer can be reduced. In the present invention, the protruding portions are formed between the primary winding and the secondary winding, so as to efficiently increase the coupling factor k of the transformer, thereby improving the energy (or signal) conversion rate and reducing energy (or signal) loss.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A transformer, comprising:

a primary winding, comprising a plurality of first protruding portions; and a secondary winding, comprising a plurality of second protruding portions, the secondary winding being adjacent to the primary winding, and the secondary winding and the primary winding inducting with each other;

wherein the first protruding portions extend to the secondary winding without electrically contacting the secondary winding, and the second protruding portions extend to the primary winding without electrically contacting the primary winding; wherein the first protruding portions are arranged on the primary winding in a single row, and the second protruding portions are arranged on the secondary winding in a single row, wherein the first protruding portions and the second protruding portions are interdigitated with one another.

2. The transformer as claimed in claim 1, wherein the first protruding portions and the second protruding portions have cuboidal shape.

3. The transformer as claimed in claim 1, wherein the first protruding portions and the second protruding portions have cylindrical shape.

4. The transformer as claimed in claim 1, wherein the primary winding is substantially disposed on a first plane, and the secondary winding is substantially disposed on a second plane, wherein the first plane is parallel to the second plane.

5. A transformer, comprising:

a primary winding, comprising a plurality of first protruding portions and a plurality of first openwork slots; and a secondary winding, comprising a plurality of second protruding portions and a plurality of second openwork slots, the secondary winding being adjacent to the primary winding, and the secondary winding and the primary winding inducting with each other;

wherein the first protruding portions extend into the second openwork slots of the secondary winding, and the first protruding portions do not electrically contact the secondary winding; the second protruding portions extend into the first openwork slots of the primary winding, and the second protruding portions do not electrically contact the primary winding.

6. The transformer as claimed in claim 5, wherein the first protruding portions and the second protruding portions have cuboidal shape.

7. The transformer as claimed in claim 5, wherein the first protruding portions and the second protruding portions have cylindrical shape.

8. The transformer as claimed in claim 5, wherein the first protruding portions are arranged on the primary winding in a single row.

9. The transformer as claimed in claim 8, wherein the second protruding portions are arranged on the secondary winding in a single row.

10. The transformer as claimed in claim 9, wherein the first protruding portions and the second protruding portions are interdigitated with one another.

11. The transformer as claimed in claim 5, wherein the first protruding portions are arranged on the primary winding in multiple rows.

12. The transformer as claimed in claim 11, wherein the second protruding portions are arranged on the secondary winding in multiple rows.

13. The transformer as claimed in claim 12, wherein the first protruding portions and the second protruding portions are interdigitated with one another.

14. The transformer as claimed in claim 5, wherein the primary winding is substantially disposed on a first plane, and the secondary winding is substantially disposed on a second plane, wherein the first plane is parallel to the second plane.

15. The transformer as claimed in claim 5, wherein each of the first protruding portions extends into one of the second openwork slots in one-to-one manner, and each of the second protruding portions extends into one of the first openwork slots in one-to-one manner.

16. A method of manufacturing the transformer, comprising:

forming a primary winding substantially on a first plane, wherein the primary winding comprises a plurality of first openwork slots;

forming a plurality of first protruding portions and a plurality of second protruding portions above the primary winding, wherein the first protruding portions are disposed on the primary winding, and first ends of the first protruding portions are electrically connected to the primary winding; and first ends of the second protruding portions are disposed in the first openwork slots, and the second protruding portions are not electrically connected to the primary winding; and forming a secondary winding substantially on a second plane, wherein the secondary winding comprises a plurality of second openwork slots; the second openwork slots are disposed on second ends of the first protruding portions, and the first protruding portions are not electrically connected to the secondary winding; and the second ends of the second protruding portions are electrically connected to the secondary winding.

17. The method of manufacturing the transformer as claimed in claim 16, wherein the first and second protruding portions have cuboidal shape.

18. The method of manufacturing the transformer as claimed in claim 16, wherein the first protruding portions and the second protruding portions have cylindrical shape.

19. The method of manufacturing the transformer as claimed in claim 16, wherein the first protruding portions are arranged on the primary winding in a single row.

20. The method of manufacturing the transformer as claimed in claim 19, wherein the second protruding portions are arranged on the secondary winding in a single row.

21. The method of manufacturing the transformer as claimed in claim 20, wherein the first protruding portions and the second protruding portions are interdigitated with one another.

22. The method of manufacturing the transformer as claimed in claim 16, wherein the first protruding portions are arranged on the primary winding in multiple rows.

23. The method of manufacturing the transformer as claimed in claim 22, wherein the second protruding portions are arranged on the secondary winding in multiple rows.

24. The method of manufacturing the transformer as claimed in claim 23, wherein the first protruding portions and the second protruding portions are interdigitated with one another.

25. The method of manufacturing the transformer as claimed in claim 16, wherein each of the first protruding portions extends from the primary winding into one of the second openwork slots in one-to-one manner, and each of the second protruding portions extends from the secondary winding into one of the first openwork slots in one-to-one manner.

26. A transformer, comprising:

a primary winding, comprising a plurality of protruding portions; and a secondary winding, comprising a plurality of openwork slots, the secondary winding being adjacent to the primary winding, and the secondary winding and the primary winding inducting with each other;

wherein the protruding portions extend to the openwork slots of the secondary winding, and the primary winding does not electrically contact the secondary winding.

27. The transformer as claimed in claim 26, wherein the protruding portions have cuboidal shape.

28. The transformer as claimed in claim 26, wherein the protruding portions have cylindrical shape.

29. The transformer as claimed in claim 26, wherein the protruding portions are arranged on the primary winding in a single row.

30. The transformer as claimed in claim 26, wherein each of the protruding portions extends to one of the openwork slots in one-to-one manner.

31. The transformer as claimed in claim 26, wherein the protruding portions are arranged on the primary winding in a multi-row matter.

32. The transformer as claimed in claim 26, wherein the primary winding is substantially disposed on a first plane and a third plane, the secondary winding is substantially disposed on a second plane, wherein the second plane is located between the first plane and the third plane, and the three planes are parallel one another.

33. A method of manufacturing the transformer, comprising:

substantially forming a part of electrical path of a primary winding on a first plane;

forming a plurality of protruding portions on the electrical path of the first plane, wherein the protruding portions are electrically connected to the primary winding;

substantially forming a secondary winding on a second plane;

forming a plurality of openwork slots on the secondary winding, and the protruding portions penetrate the openwork slots, and the protruding portions are not electrically connected to the secondary winding; and substantially forming another electrical path of the primary winding on a third plane, wherein the primary winding is formed by electrical connection of the protruding portions and the electrical paths of the first plane and the third plane;

wherein the second plane is located between the first plane and the third plane, and the three planes are parallel one another.

34. The method of manufacturing the transformer as claimed in claim 33, wherein the protruding portions have cuboidal shape.

35. The method of manufacturing the transformer as claimed in claim 33, wherein the protruding portions have cylindrical shape.

36. The method of manufacturing the transformer as claimed in claim 33, wherein the protruding portions are arranged on the primary winding in a single row.

37. The method of manufacturing the transformer as claimed in claim 33, wherein each of the protruding portions extends to one of the openwork slots in one-to-one manner.

38. The method of manufacturing the transformer as claimed in claim 33, wherein the protruding portions are arranged on the primary winding in a multi-row matter.

39. A transformer, comprising:

a primary winding, comprising a plurality of first protruding portions; and a secondary winding, comprising a plurality of second protruding portions, the secondary winding being adjacent to the primary winding, and the secondary winding and the primary winding inducting with each other;

wherein the first protruding portions extend to the secondary winding without electrically contacting the secondary winding, and the second protruding portions extend to the primary winding without electrically contacting the primary winding;

wherein the first protruding portions are arranged on the primary winding in multiple row, and the second protruding portions are arranged on the secondary winding in multiple row, wherein the first protruding portions and the second protruding portions are interdigitated with one another.

* * * * *